United States Patent [19]

Jezbera

[11] 4,407,194

[45] Oct. 4, 1983

[54] PRINT HAMMER

[75] Inventor: Val K. Jezbera, Thousand Oaks, Calif.

[73] Assignee: Dataproducts Corporation, Woodland Hills, Calif.

[21] Appl. No.: 339,747

[22] Filed: Jan. 15, 1982

Related U.S. Application Data

[63] Continuation of Ser. No. 122,064, Feb. 5, 1980, abandoned.

[51] Int. Cl.[3] ..... B41J 9/30

[52] U.S. Cl. ..... 101/93.34; 101/93.48

[58] Field of Search ..... 101/93.02, 93.29, 93.30, 101/93.31, 93.32, 93.33, 93.34, 93.48

[56] References Cited

U.S. PATENT DOCUMENTS

| | | | |
|---|---|---|---|
| 3,172,353 | 3/1965 | Helms | 101/93.48 |
| 3,279,362 | 10/1968 | Helms | 101/93.34 X |
| 3,568,593 | 3/1971 | Papadopoulos | 101/93.34 |
| 3,905,294 | 9/1975 | Barris et al. | 101/93.48 |
| 3,941,052 | 3/1976 | Dalziel | 101/93.48 |
| 3,983,806 | 10/1976 | Ishi | 101/93.34 X |
| 4,037,532 | 7/1977 | Plaza et al. | 101/93.48 |

*Primary Examiner*—Edward M. Coven

*Attorney, Agent, or Firm*—Spensley, Horn, Jubas & Lubitz

[57] ABSTRACT

An improved print hammer incorporating crossed-spring support wires having a round cross section so as to render the hammer relatively flexible in a direction lateral to hammer travel during printing. The spring wires are connected between a lower body portion and a foot section. The lower body portion and foot section are designed so that the spring wires enter them substantially perpendicularly, thereby reducing stress. The foot section incorporates a pair of mounting pegs which serve to accurately locate the hammers in a hammer bank assembly. A pair of weights can be included on the spring wires in order to dampen recoil motion which occurs after the hammer impacts against a print character. The crossing point of the spring is positioned so that the springs are flexed by a constant bending moment, thereby reducing stress on the springs.

15 Claims, 7 Drawing Figures

Fig. 5.
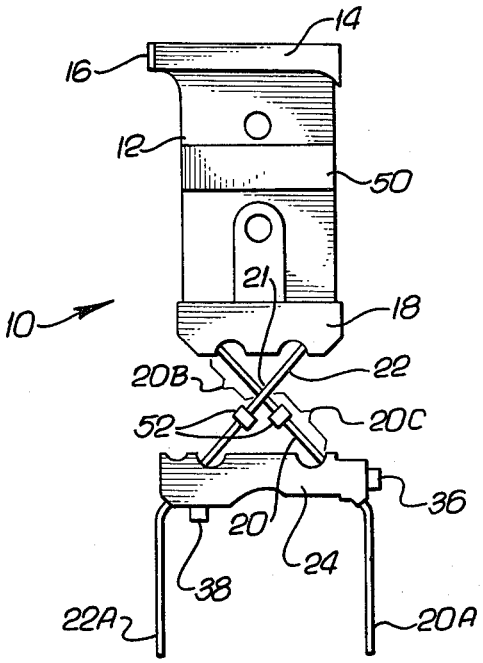
Fig. 7.
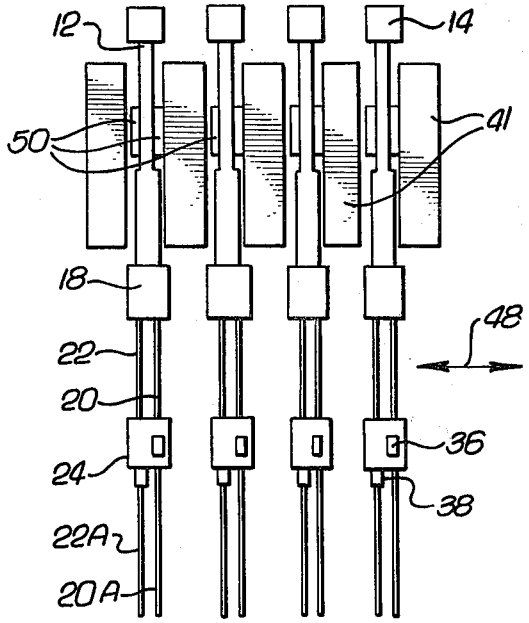
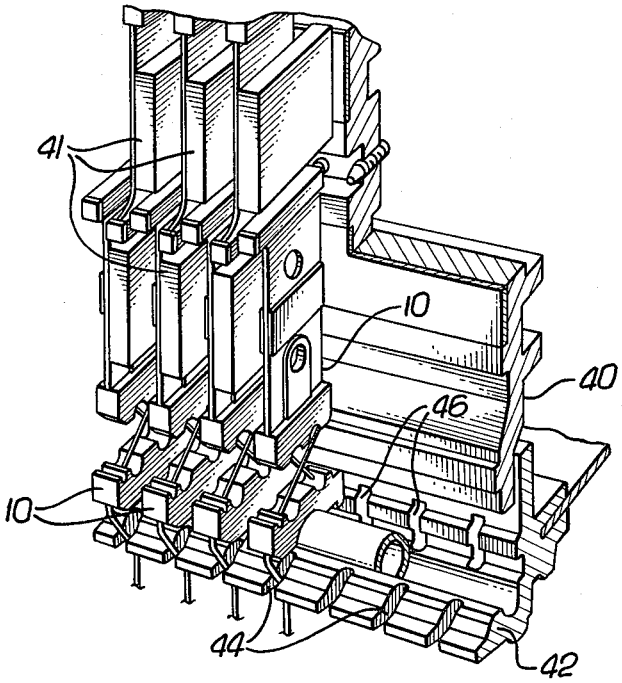
Fig. 6.

PRINT HAMMER

This is a continuation of application Ser. No. 122,064 filed Feb. 5, 1980, now abandoned.

BACKGROUND OF THE INVENTION

1. Field of the Invention

The present invention relates to a print hammer for use in a printing mechanism.

2. Description of the Prior Art

In high-speed, moving-type impact printers of the kind typically employed in data processing systems, a separate print hammer is situated at each print position across a row of type. Hammer bank assemblies for this purpose are described in U.S. Pat. Nos. 3,643,595 to Helms et al and U.S. Pat. No. 3,983,806 to Ishi, and in copending U.S. Patent Application Ser. No. 065,766, filed Aug. 20, 1979, all assigned to Dataproducts Corporation, the assignee of the present invention.

Such hammer bank assemblies utilize a plurality of print hammers each having a flat, electrically conductive coil disposed in a generally rigid housing or body having an impact tip at one end and supported by a pair of crossed spring wires at the other end. The springs provide electrical contact to the coil, and air in restoring the hammer to its rest position subsequent to impact. In the hammer bank assembly, each hammer is situated between a pair of stationarily mounted flat permanent magnets. When a current flows through the coil, the resultant magnetic field interacts with the field of the permanent magnet, resulting in a force which propels the hammer towards the type font and the medium being printed. The basic configuration and operation of such a printing hammer is set forth in U.S. Pat. No. 3,279,362 to Helms, also assigned to Dataproducts Corporation. Other hammers are shown in U.S. Pat. No. 3,279,364, to Helms, U.S. Pat. No. 3,643,595 to Helms, et al and U.S. Pat. No. 3,983,806 to Ishi.

Print hammers and hammer bank assemblies of the type disclosed above have proven to be very effective in use, have exhibited high reliability and long lifetime as measured in the number of impact operations between replacement, and have gained widespread acceptance. However, new designs for hammer bank assemblies require hammers which have an even longer lifetime and which exhibit different operating characteristics than prior art hammers. Specifically, in the prior art, hammer bank assemblies were designed such that the crossed spring wires were flat and very rigid in the horizontal direction, thus preventing any side to side motion of the hammers. The body of each hammer was located between a pair of magnets, and the rigidity of the crossed spring wires served to keep the body in the correct position between two magnets. If, however, the body of the hammer were to come in contact with the side of a magnet, the friction between the body and the magnet would interfere with the performance of the hammer. Therefore, it was critical that the hammers be accurately mounted so as to not contact either of the magnets which surround them.

In contrast to the hammers used in prior art assemblies, it is an object of the present invention to achieve a hammer which is relatively flexible from side to side. This flexibility enables the hammer bank assembly to be designed so that the hammers are normally biased against the magnets. Because of the flexibility, the normal force and the friction between the magnets and hammers is relatively very low.

Further objectives of the present invention include the following:

(1) the further strengthening of the different components of the hammer;

(2) the elimination of some components of prior art hammers;

(3) the elimination of flat wire, formed springs;

(4) the elimination of close manufacturing tolerances of certain hammer components;

(5) the controlling of friction between the hammers and magnets.

SUMMARY OF THE INVENTION

These and other objectives are achieved by a print hammer which utilizes flexible spring members having a round cross section, which reduces friction between the hammers and magnets when they contact one another. A Teflon TM impregnated woven glass tape may be wrapped around the housing of the hammer in order to further reduce friction.

The housing of the hammer is designed with a bottom section which is formed so that the spring wires enter it in a substantially perpendicular fashion. This serves to reduce the concentration of stress in the spring wires when the hammer is actuated. In addition, the foot section is also designed so that the spring wires enter it substantially perpendicularly, so as to reduce concentration of stress in spring wires.

In order to achieve the maximum deflection of the springs with minimum stress, the hammer is designed so that the spring wires cross at a point which makes their length above the crossing point unequal to their length below the crossing point. The relative lengths are controlled so that the springs have a relatively constant bending moment along their entire length.

In order to reduce and dampen the recoil motion of the hammers after actuation, weights which surround the wires may be included.

By utilizing the above features in a print hammer, hammer bank assemblies having substantially different operational characteristics from those of the prior art may be produced. Rather than having very rigid hammers which must be extremely accurately located in the space between magnets of a hammer bank assembly, the use of flexible hammers permits the hammers to be deliberately biased against the magnets. If the magnets are accurately located in the assembly, the hammers will in turn be accurately positioned.

Although each of the above features may be employed individually in order to improve certain performance aspects of print hammers, they may all be combined in one design so as to result in a print hammer which is vastly improved over prior art designs.

BRIEF DESCRIPTION OF THE DRAWINGS

In the drawings:

FIG. 5 is a side view of the print hammer of the present invention;

FIG. 6 is a perspective view of a portion of a hammer bank assembly; and

FIG. 7 is a front plan view showing the relationship between print hammers and magnets in a hammer bank assembly.

DETAILED DESCRIPTION OF THE PREFERRED EMBODIMENTS

The following detailed description is of the best presently contemplated mode of carrying out the invention. This description is not to be taken in a limiting sense but is made merely for the purpose of illustrating the general principles of the invention since the scope of the invention is best defined by the appended claims.

Figure 1:
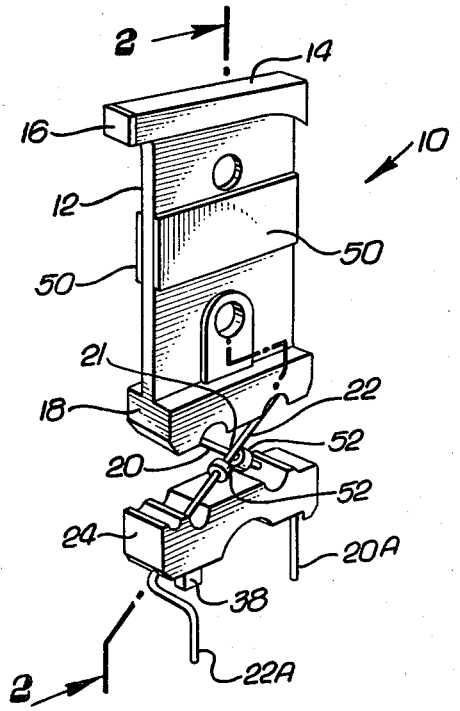
FIG. 1 is a perspective view of the print hammer of the present invention.
Figure 2:
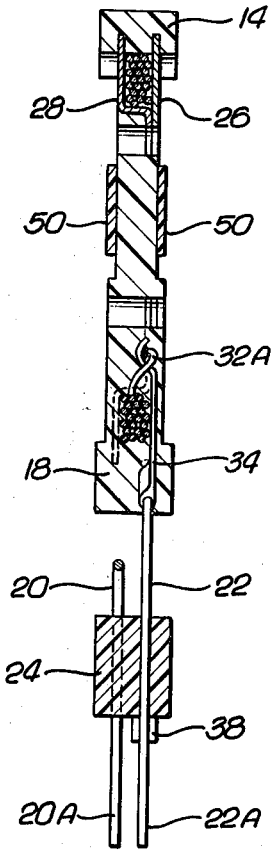
FIG. 2 is a front section view of the print hammer of the present invention.

A print hammer 10 according to the present invention is shown in FIGS. 1 and 2. The hammer 10 consists of a body or coil housing 12 containing a flat coil 32 (FIG. 3) sandwiched between a pair of flags 26 and 28 (described below) and embedded in a molding compound such as a structural epoxy. The central portion of the coil housing 12 may have a typical thickness on the order of 0.035 inches. The hammer 10 includes an impact end 14 which has an enlarged thickness, typically on the order of 0.10 inches, and includes a forwardly projecting impact tip 16.

Projecting diagonally in opposite directions from an enlarged bottom end 18 of the housing 12 are a pair of spring wires 20 and 22, each having a round cross section. The spring wires 20 and 22 are laterally separated from one another so that they do not touch at their apparent crossover location shown at 21 in FIG. 1. This separation may be seen more clearly in FIG. 2. The spring wires 20 and 22 pass through, and are embedded in, a foot member 24 formed of the same molding compound as the coil housing 12. The lower ends 20A and 22A of the spring wires 20 and 22 project below the foot member 24 and are available for electrical connection to the hammer 10.

Figure 3:
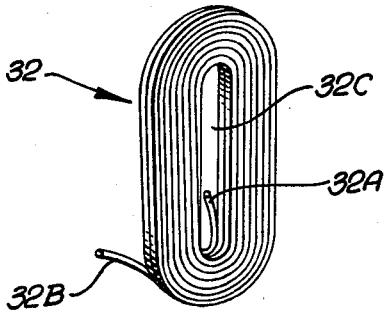
FIG. 3 is a perspective view of a wire coil used in the print hammer of the present invention.
Figure 4:
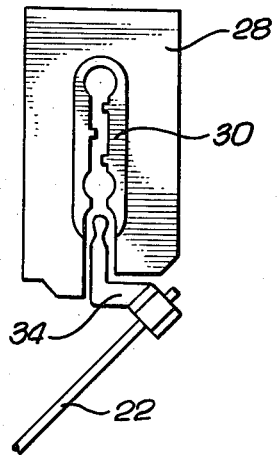
FIG. 4 is a plan view of a flag which forms a part of the print hammer.

Referring now to FIGS. 2, 3 and 4, the flags 26 and 28 are punched from thin metal strips. By way of example, the flags 26 and 28 may be formed by aluminum having a thickness of 0.004 inches. In addition, the flag 28 includes an embossed or raised locating portion or core 30 in its central area corresponding in size to the interior 32*c* of the coil 32, which serves to accurately locate the coil 32 with respect to the flag 28. The inner lead 32A of the coil 32 is connected to the spring wire 20 by means of a flat strip 34. The outer lead 32*b* is connected directly to the spring wire 22. The actual construction steps involved in manufacturing the hammer 10 are fully described in copending Application Ser. No. 968,278, filed Dec. 11, 1978.

Referring to FIG. 5, it can be seen that the lower portion 18 and the foot section 24 are shaped so that the spring wires 20 and 22 enter them generally perpendicularly. When the hammer coil 32 is energized by applying current through the spring wires 20 and 22 and the hammer 10 is impacting the spring wires 20 and 22 will flex a great deal, thus causing the generation of a large amount of stress in spring wires 20 and 22. By forming the lower portion 18 and the foot 24 so that the spring wires 20 and 22 enter them generally perpendicularly, the concentration of stress in the wire housing junction is greatly reduced. This allows spring of smaller diameter (and therefore lower spring constant) to be used, thus increasing the efficiency of the hammer components.

Referring further to FIG. 5, it may be seen that the foot section 24 includes a pair of mounting pegs 36 and 38. The pegs are offset from one another such that the peg 36 is aligned (i.e., coplanar) with the spring wire 20 and the peg 38 is aligned with the spring wire 22. The mounting pegs 36 and 38 are utilized to accurately mount each individual print hammer in a hammer bank assembly. As shown in FIG. 6, a hammer bank mounting assembly includes a frame having a rear vertical portion 40, to which a plurality of spaced parallel magnets 41 are secured, and a forwardly-extending horizontal portion 42. Formed in the horizontal portion 42 are a group of front parallel equally-spaced slots 44 and rear parallel equally-spaced slots 46. The front slots 44 are offset with respect to the rear slots 46 by an amount equal to the offset between the mounting pegs 36 and 38 of a hammer. The hammers are mounted in the hammer bank assembly by passing the lower portions 20A and 22A of the spring wires through the slots 46 and 44 respectively, and fitting the pegs 36 in a slot 46 and the tab 38 in a slot 44. The pegs 36 and 38 fit snugly in the slots 46 and 44 and therefore serve to accurately position the hammer within the assembly. Details of the hammer bank assembly are fully described in copending U.S. Patent application Ser. No. 065,766, assigned to the same assignee of the present invention.

Referring now to FIG. 7, when the hammers are mounted in the hammer bank assembly, they are interleaved with the magnets 41. In prior hammer bank assemblies, the hammers are positioned so that their sides would not touch the magnets while the hammers were at rest. In addition, the hammers were made side stiff so that their energization would not cause them to move sideways and scrape against the magnets as they impacted against the printing medium. In the assembly shown in FIG. 7, however, each hammer 10 is mounted so that its body 12 is biased against the side of a magnet 41. Because the spring wires 20 and 22 have a round cross section, they are relatively flexible in the horizontal direction (indicated by arrow 48.) It should be noted that spring wires having a substantially square cross-section would also be flexible in the horizontal direction. By biasing the hammers 10 against the magnets 41, a known and small amount of friction is created. Since this friction is known, it may be taken into account when designing for the motion of the hammers 10 when they are energized. That is, the motion of the hammers 10 will be predictable and consistent despite the fact that they touch the magnets 41. Because the wires 20 and 22 have a round cross section and are relatively flexible, the amount of friction created is relatively low and thus does not greatly impede the motion of the hammers. By deliberately designing the hammer bank assembly such that the hammers are in contact with the magnets and planning on a certain amount of friction, the criticality of positioning of the hammers so that they do not touch anything as they move is eliminated. By making the spring wires 20 and 22 flexible in the direction indicated by the arrow 48, and by biasing the hammers 10 against the magnets 41, a hammer bank assembly which achieves high accuracy in printing but has a low degree of criticality in manufacturing tolerances may be achieved. In order to further reduce the amount of friction between the magnets 41 and the hammers 10, a woven glass tape 50 (FIG. 1) impregnated with a low friction material such as that sold under the trademark Teflon may be applied to the sides of the body 12.

Referring again to FIG. 5, a weight 52 is shown attached to each of the spring wires 20 and 22. When the hammer 10 is energized, it will move forward and the tip 16 will impact against a paper and cause a character to be printed. When the impact tip 16 strikes the paper (and type font located behind the paper), its forward motion halts. At this point, however, the hammer 10 still has a great deal of stored energy. The striking of the paper will cause the pivot point of the hammer to move from the crossing point 21 of the springs 20 and 22 to the impact tip 16. Thus, after the impact tip 16 strikes the paper, a great deal of energy will be stored in the springs 20 and 22. They will then recoil and oscillate until the hammer 10 returns to rest at its equilibrium position. Without the weights 52, the hammer 10 will recoil to such an extent that more stress will be placed on the springs 20 and 22 than during actual impact. The addition of the weights 52 acts to limit the initial amount of recoil and dampen the subsequent oscillations of the springs 20 and 22. The addition of the weights 52 to the springs 20 and 22 will not change their spring constants, but will influence their natural frequencies and mass. The recoil motions of the springs 20 and 22 are therefore reduced.

Each time the hammer 10 is energized, a stress is placed on the springs 20 and 22 as they are deflected. In order to increase the life of the hammer 10, the maximum stress at any point on the springs for a given deflection should be minimized. Deflection of the springs 20 and 22 can be accomplished either by applying a single force to the spring or by applying a bending moment or combination of both. Although any method will cause the desired amount of deflection at any particular point, the stress which will be placed upon the spring will be vastly different. When a single force is utilized the stress placed upon the spring 20 near the foot 24 will be very high, since the maximum bending will occur near the foot 24. When a bending moment is utilized however, the maximum stress placed upon the spring 20 at any point will be much lower, since the curvature of the spring 20 will be spread over its length rather than concentrated near the foot 24.

In prior hammer designs, the crossing point 21 was located in the middle of the springs and spring deflection was accomplished in a fashion resulting in an uneven distribution of stress in the spring. In the present design, however, the springs 20 and 22 are oriented such that deflection is caused by the application solely of a bending moment. This results in lower stress and longer life. The use of a bending moment to cause deflection of the springs 20 and 22 is accomplished by controlling the dimensions of the springs and the position of their crossing point 21 (i.e., the length of the portion of the springs 20 or 22 above the crossing point relative to the length of the portion below the crossing point). Basically, the crossing point is positioned such that the portion below it is longer than the portion above it. Thus, in FIG. 5, the upper portion 20*b* of the spring 20 is shorter than the lower portion 20*c*. The control of the crossing point in this manner assures that the spring 20 will be flexed by a bending moment rather than by a single force, thus minimizing stress on the spring 20. The design results in a constant bending moment being applied along the length of the springs, resulting in an even stress distribution along the length of the springs.

In summary, the present invention is directed to an improved print hammer for use in a hammer bank assembly of a high-speed printer or the like. The hammer includes several new features which enable a significant improvement in performance to be achieved. Crossed spring wires which are used to support the hammer body have a round cross section, thereby rendering the hammer body relatively flexible in the horizontal direction. This permits the hammers to be mounted so that they are biased against the magnets in a hammer bank assembly. This bias creates a known small amount of friction, which may be taken into account in the design of the system. The hammer body and foot member of the hammer are designed so that the spring wires supporting the body are attached to the body and foot in a substantially perpendicular fashion, thereby reducing concentration of stress in the spring wires. The foot includes molded mounting pegs which aid in accurately mounting the hammers in a hammer bank assembly. One of a pair of metal flags, which form the body of the hammer and sandwich a coil, includes a raised mounting surface to aid in accurately locating the coil in the hammer assembly. In addition, weights located on the springs are utilized to dampen the recoil motion of the supporting springs after the hammer has impacted against a character.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. In a print hammer for use in a hammer bank assembly which has a plurality of hammers interleaved with a plurality of spaced magnets, said hammer including a body comprising a pair of thin metal flag panels and a wire coil sandwiched between said flag panels, a pair of crossed spring wires extending from said panels, each of said spring wires being electrically connected to a different end of said coil, and a foot section through which said spring wires extend, the improvement wherein said spring wires are substantially as flexible in a direction lateral to their direction of travel when energized in said hammer bank assembly as they are in the direction of hammer travel.

2. The print hammer of claim 1 including a low friction coating attached to the sides of the flag panels.

3. The print hammer of claim 2 wherein said coating is a tape which is made of woven glass.

4. The print hammer of claim 1 wherein said spring wires have a substantially square cross-section.

5. A hammer bank assembly including a plurality of print hammers according to claims 1 or 2, said assembly comprising:

a frame including a vertical rear portion and a horizontal portion extending forward from said rear portion;

a plurality of printer magnets secured to said rear portion parallel to one another and spaced apart a predetermined distance;

a plurality of print hammers whose foot sections are secured to said horizontal portion and whose bodies are interleaved with said magnets, wherein one side of each body is biased against an adjacent magnet to thereby accurately position the hammers and whereby a predetermined low amount of friction will exist between the hammers and magnets.

6. The print hammer of claim 1 wherein said spring wires have a substantially circular cross-section.

7. The print hammer of claim 6 wherein the bottom portions of said flag panels are encased in a housing of structural epoxy and said foot member is made of structural epoxy, wherein said housing and foot member are shaped so that said spring wires enter them substantially perpendicularly to thereby reduce stress on said structural epoxy.

8. The print hammer of claim 7 wherein the portion of the spring wires between the point where they cross and the housing is shorter than the portion of the spring wires between the point where they cross and where they enter the foot section, thereby reducing stress on said spring wires.

9. The print hammer of claim 8 further including at least one weight surrounding each spring wire to reduce and dampen recoil motion of said hammer.

10. In a print hammer including a body which includes a pair of thin metal flag panels and a wire coil sandwiched between said flag panels, a bottom section connecting the bottoms of the flags, a pair of laterally offset crossed spring wires extending from said bottom section, each of said spring wires being electrically connected to a different end of said coil, and a foot section through which said spring wires extend, the improvement wherein the portion of each spring wire between the bottom section and the foot section is substantially straight and said bottom section is shaped so that the spring wires enter said bottom section of the hammer substantially perpendicularly, thereby reducing stress on said hammer.

11. The print hammer of claim 10 wherein said foot section is shaped so that the spring wires enter the foot section of the hammer substantially perpendicularly.

12. In a print hammer including a body which includes a pair of thin metal flag panels and a wire coil sandwiched between said flag panels, a bottom section connecting the bottoms of the flags, a pair of laterally offset crossed spring wires extending from said bottom section, each of said spring wires being electrically connected to a different end of said coil, and a foot section through which said spring wires extend, the improvement wherein the portion of each spring wire between the bottom section and the foot section is substantially straight and said foot section is shaped so that the spring wires enter said foot section substantially perpendicularly, thereby reducing stress on said hammer.

13. A print hammer for use in a printer in which plural hammers are interleaved with and contact rigid magnets supported in a bank, comprising:

a coil located in a flat body, whereby energization of said coil generates a magnetic field which interacts with the magnetic field of the magnets to impart a force to the body which causes the body to move and impact a printing mechanism;

a pair of crossed wires extending from said body, said wires being attached to a foot member which is secured to the printer, wherein said wires are laterally flexible in a direction perpendicular to the plane of the body to thereby minimize friction between the hammer and a magnet when located in a bank, said print hammer further including a low friction coating located on the sides of the body to thereby further reduce friction between the hammer and a magnet.

14. The print hammer of claim 13 wherein said coating comprises a low friction tape.

15. A print hammer for use in a printer in which plural hammers are interleaved with and contact rigid mangets supported in a bank, comprising:

a coil located in a flat body, wherein energization of said coil generates a magnetic field which interacts with the magnetic field of the magnets to impact a force to the body which causes the body to move and impact a printing mechanism;

a pair of crossed wires extending from said body, said wires being attached to a foot member which is secured to the printer, wherein said wires are laterally flexible in a direction perpendicular to the plane of the body to thereby minimize friction between the hammer and a magnet when located in a bank wherein said wires join said body and said foot member at a substantially perpendicular angle, thereby minimizing the stress imparted to said body and said foot member during impacting, and further including:

a pair of weights situated on the wires to damp oscillation thereof after printing impact.

* * * * *